US006857544B2

(12) United States Patent
Dahl

(10) Patent No.: US 6,857,544 B2
(45) Date of Patent: Feb. 22, 2005

(54) BEVERAGE BOTTLE CARRIER

(76) Inventor: Phyllis S. Dahl, 3486 King Rd., Liberty, MS (US) 39645

( * ) Notice: Subject to any disclaimer, the term of this patent is extended or adjusted under 35 U.S.C. 154(b) by 215 days.

(21) Appl. No.: 10/159,338

(22) Filed: May 30, 2002

(65) Prior Publication Data

US 2003/0080165 A1 May 1, 2003

Related U.S. Application Data

(63) Continuation-in-part of application No. 10/004,069, filed on Oct. 25, 2001, now Pat. No. 6,533,148.

(51) Int. Cl.[7] ..... A45F 5/00

(52) U.S. Cl. ..... 224/148.4; 224/148.6; 224/148.7; 224/679; 224/269

(58) Field of Search ..... 224/148.1, 148.4–148.7, 224/600, 601, 620, 660, 671, 672, 674, 675, 247, 414, 416, 417, 926, 901.4, 269, 679

(56) References Cited

U.S. PATENT DOCUMENTS

D286,949 S * 12/1986 Hardman ..... 224/197
5,320,232 A 6/1994 Maguire
5,398,855 A * 3/1995 Schaiewitz ..... 224/257
5,695,232 A * 12/1997 Tipp ..... 206/150
6,086,124 A * 7/2000 Wang ..... 224/148.4
6,131,779 A * 10/2000 Gendala ..... 224/148.7
6,279,794 B1 * 8/2001 Miyazaki ..... 224/148.7

* cited by examiner

*Primary Examiner*—Nathan J. Newhouse
(74) *Attorney, Agent, or Firm*—David L. Ray

(57) ABSTRACT

A beverage bottle carrier apparatus for enabling an individual to carry one or more beverage bottles. The beverage bottle carrier of the invention includes an elongated generally rectangular flexible strap having a handle portion in the approximate middle thereof for easy grasping by a hand of a person carrying one or more beverage bottles, the flexible strap having two ends and a buckle assembly for connecting the two ends together, one end of the strap having a male portion of the buckle assembly connected thereto and the other end of the strap having a female portion of the buckle assembly connected thereto, and a hooking mechanism connected to said male portion and said female portion, the hooking mechanism being adapted to be force-fitted around the neck of a beverage bottle to grasp and hold a beverage bottle therein.

In a second embodiment of the invention, the beverage bottle carrier of the invention includes a hook portion for receiving the neck of a beverage bottle and a belt receiving portion oriented generally perpendicular to the hook portion.

In a third embodiment of the invention, the beverage bottle carrier includes an elongated handle having two hook portions thereon for engaging and holding a beverage bottle.

1 Claim, 7 Drawing Sheets

BEVERAGE BOTTLE CARRIER

CROSS REFERENCE TO RELATED APPLICATIONS

This application is a continuation-in-part of my application Ser. No. 10/004,069 filed Oct. 25, 2001 U.S. Pat. No. 6,533,148.

BACKGROUND OF THE INVENTION

1. Field of the Invention

The present invention relates to apparatus for carrying beverage bottles. In particular the present invention relates to devices having straps which are connected to beverage bottles and held by the hands of the person carrying the beverage bottles or carried draped over and supported by another portion of the carrier's body such as the shoulder or the waist.

2. Description of the Related Art

Beverage bottles come in a large variety of shapes and sizes. Beverage bottles are commonly made of polymeric materials which do not shatter as glass containers do when dropped. Such polymeric beverage bottles are commonly made in large one, two, and three liter sizes which are heavy and difficult to carry by hand.

Such beverage bottles are commonly transported to beaches and other recreational areas from a vehicle to an area where the beverages are consumed. When individuals need to carry such bottles, beverage bottle carriers are needed to enable an individual to carry the bottles more easily than grasping the bottles individually by hand.

Beverage bottle carriers are known in the art. Exemplary of the Patents of the related art are the following U.S. Pat. Nos. 3,297,220; 4,678,221; 4,776,622; 5,096,246; 5,320,232; 5,437,401; 5,441,320; Re. 35,288; 5,603,545; 5,695,232; 5,735,562; 5,927,781; 6,029,870; and 6,352,235 B2.

BRIEF SUMMARY OF THE INVENTION

In accordance with the present invention there is provided an apparatus for enabling individual to carry one or more beverage bottles. The beverage bottle carrier of the invention includes an elongated generally rectangular flexible strap having a handle portion in the approximate middle thereof for easy grasping by a hand of a person carrying one or more beverage bottles, the flexible strap having two ends and a buckle assembly for connecting the two ends together, one end if the strap having a male portion of the buckle assembly connected thereto and the other end of the strap having a female portion of the buckle assembly connected thereto, and a hooking mechanism connected each of the male and female portions, the hooking mechanism being adapted to be force-fitted around the neck of a beverage bottle to grasp and hold a beverage bottle therein.

In a second embodiment of the invention, the beverage bottle carrier of the invention includes a hook portion for receiving the neck of a beverage bottle and a belt receiving portion oriented generally perpendicular to the hook portion.

In a third embodiment of the invention, the beverage bottle carrier includes an elongated handle having two hook portions thereon for engaging and holding a beverage bottle.

The beverage bottle carrier of the invention has the advantage of being quickly and easily connected to the neck of a beverage bottle for lifting, supporting, and transporting a beverage bottle.

The beverage bottle carrier of the invention has the additional advantage of being light weight and inexpensive.

DETAILED DESCRIPTION OF THE INVENTION

Figure 1:
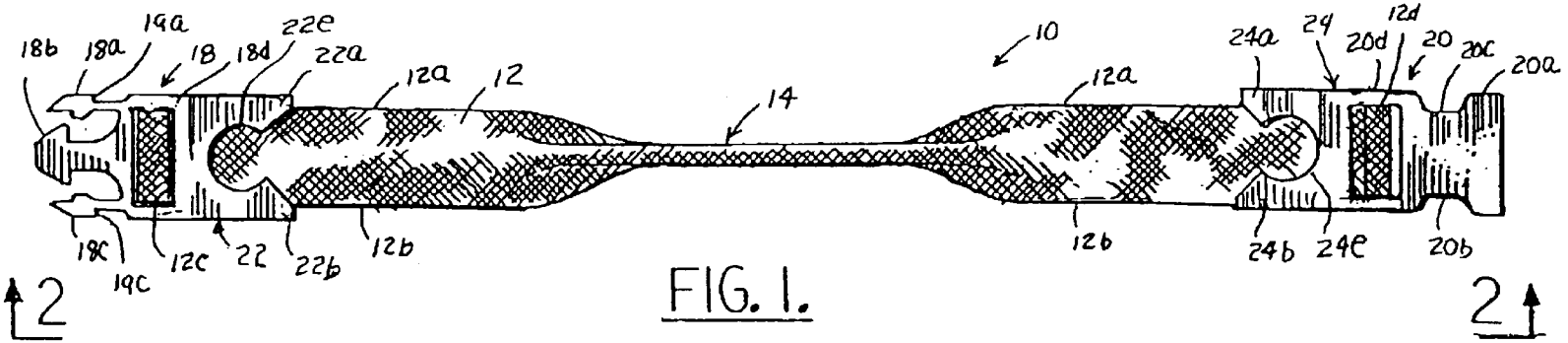
FIG. 1 is top plan view of the beverage bottle carrier of the invention.
Figure 2:
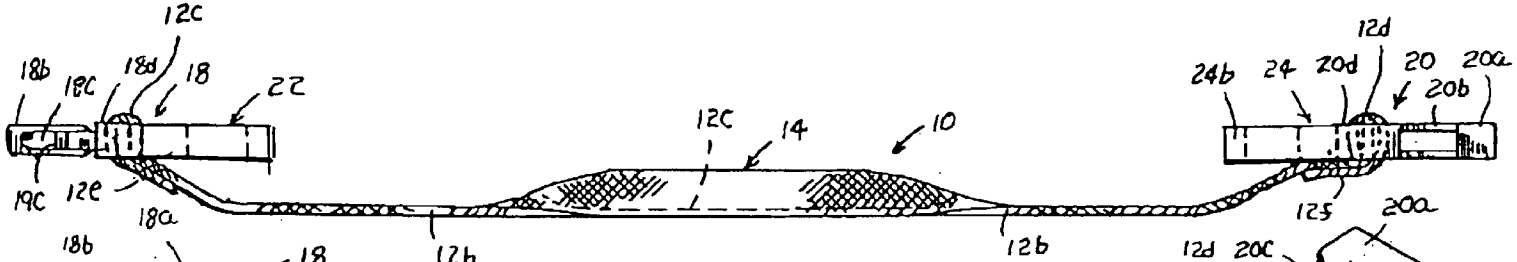
FIG. 2 is side elevational view of the beverage bottle carrier of the invention.

Referring now to the drawings, and in particular to FIGS. 1 and 2, the beverage bottle carrier of the invention is generally indicated by the numeral 10. Beverage bottle carrier 10 includes a flat, generally rectangular elongated strap 12 having a handle portion generally indicated by the numeral 14 in the center thereof preferably formed by folding the opposite edges 12*a* and 12*b* of rectangular strap together and connecting the edges. Edges 12*a* and 12*b* are connected together at the approximate center of strap by sewing, heat sealing, or the like at seam 12*c* to form handle portion 14.

Elongated strap 12 is preferably made from a woven flexible polymeric plastic material well known in the art. However, if desired, elongated strap 12 could be made from a solid flexible polymeric strip, leather, woven natural or synthetic fibers, or the like.

Figure 3:
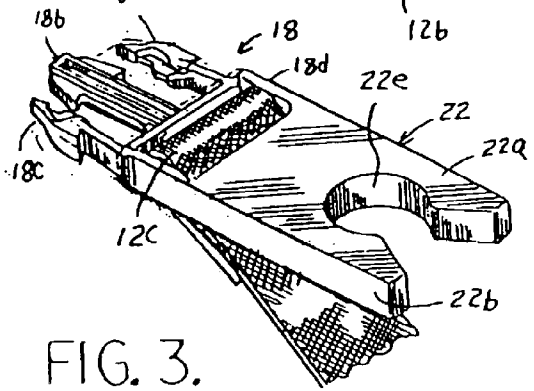
FIG. 3 is an enlarged partly cut-away perspective view of the male portion of the buckle assembly of the beverage bottle carrier of the invention.
Figure 4:
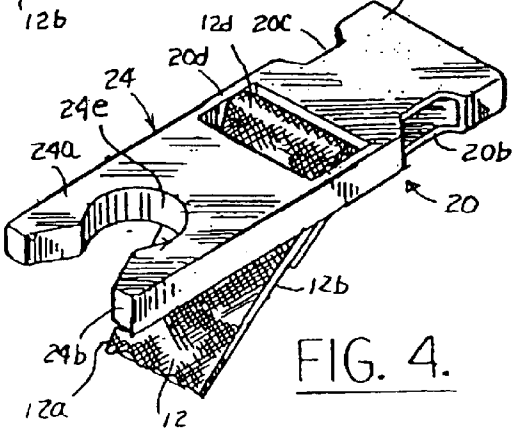
FIG. 4 is an enlarged partly cut-away perspective view of the female portion of the buckle assembly of the beverage bottle carrier of the invention.
Figure 5:
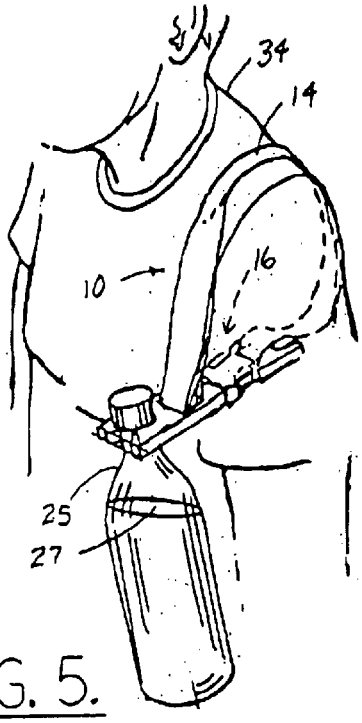
FIG. 5 is a partly cut-away perspective view of the beverage bottle carrier of the invention shown draped over the shoulder of a person carrying a beverage bottle, part of the beverage bottle carrier of the invention being shown in phantom lines.
Figure 7:
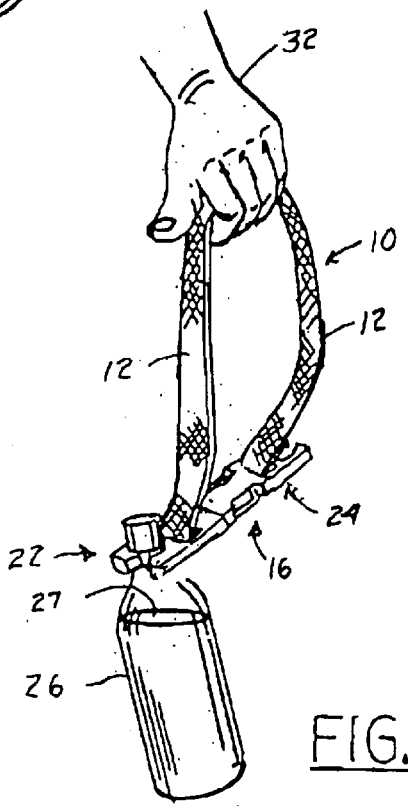
FIG. 7 is a partly cut-away perspective view of the beverage bottle carrier of the invention shown supported by the hand of a person carrying a single beverage bottle.
Figure 8:
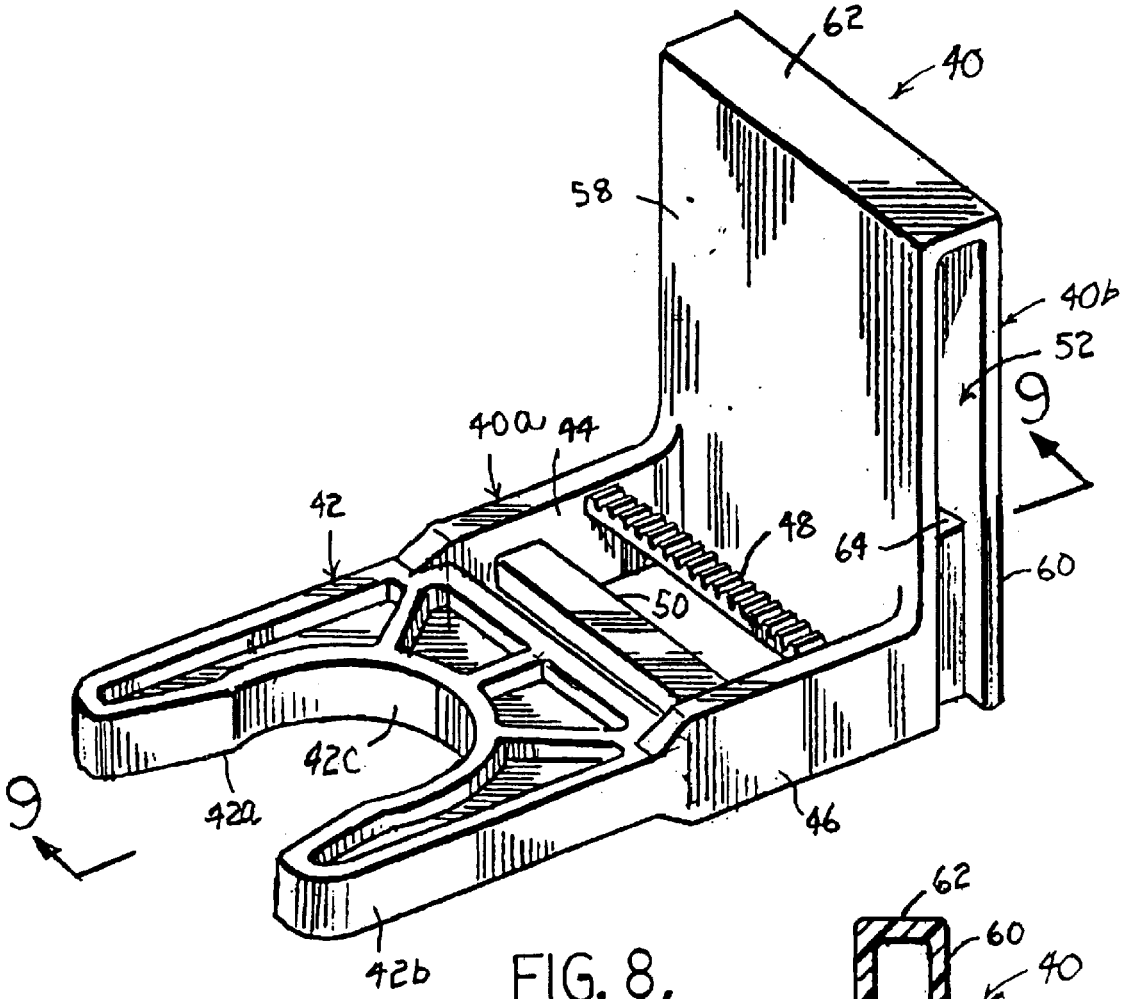
FIG. 8 is an enlarged perspective view of the second embodiment of the beverage bottle carrier of the invention having a belt loop therein.
Figure 9:
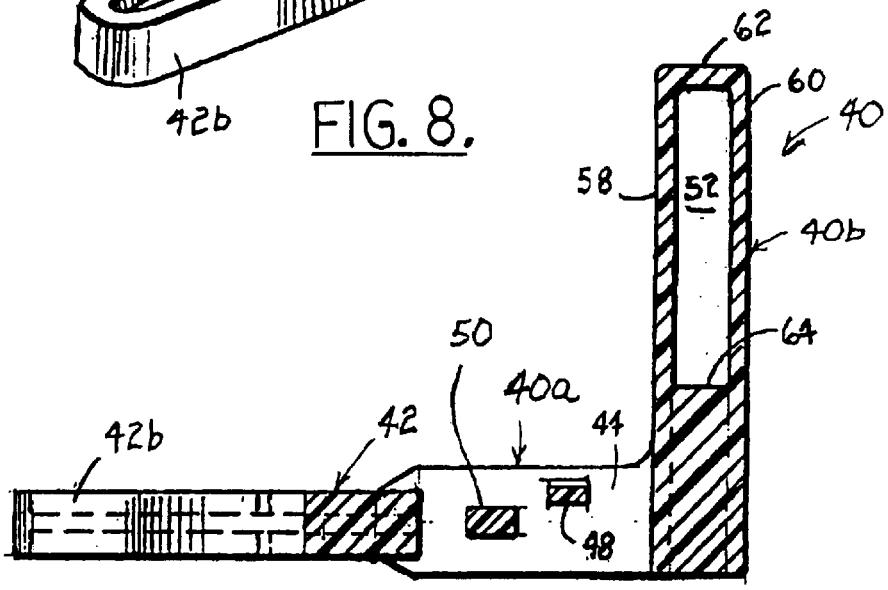
FIG. 9 is a cross-sectional view taken along lines 9—9 of FIG. 8.
Figure 10:
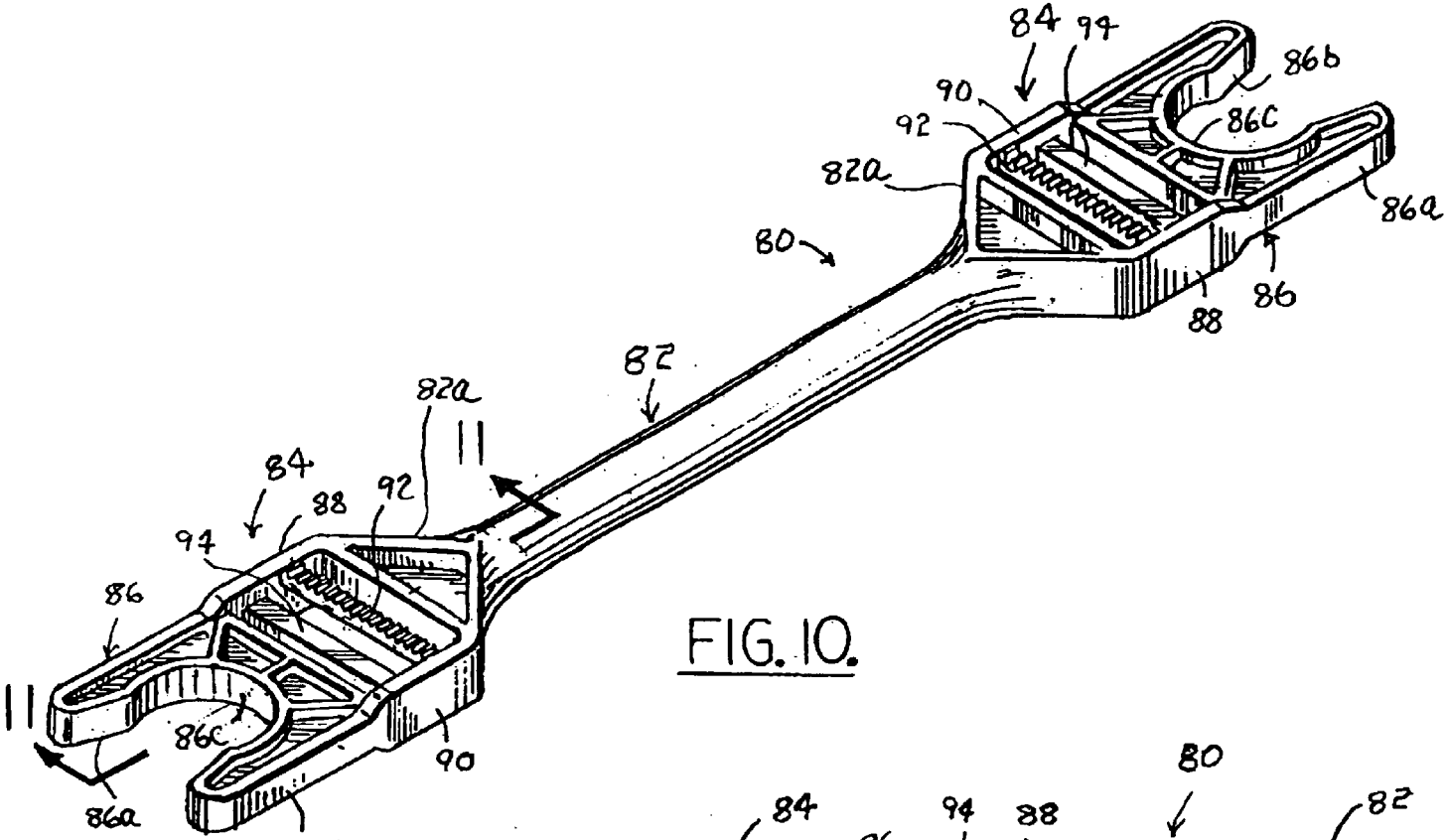
FIG. 10 is an enlarged perspective view of a third embodiment of the beverage bottle carrier of the invention having a rigid handle and two hooks for carrying bottles.
Figure 11:
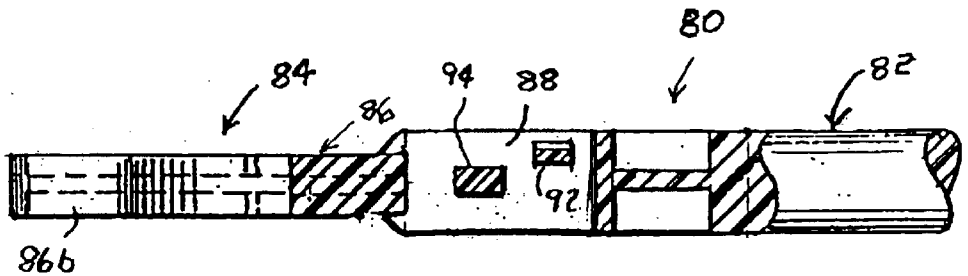
FIG. 11 is a cross-sectional view taken along lines 11—11 of FIG. 10.

A buckle assembly generally indicated by the numeral 16 in FIGS. 5 and 7 is used to connect each of the two ends of elongated strap 12 together. Buckle assembly 16 includes a male portion generally indicated by the numeral 18 in FIGS. 1–3 and a female portion generally indicated by the numeral 20 in FIGS. 1, 2 and 4 connected to each of the two ends of elongated strap 12.

Male portion 18 includes three generally parallel flexible prongs 18*a*, 18*b*, and 18*c* which are integrally formed with a clasp 18*d*. One end of strap 12 is received in clasp 18*d* and connected thereto to form loop 12*c* in strap 12 by connecting the end of strap 12 to strap 12 at 12*e* by sewing, riveting, or the like.

Female portion 20 has a hollow body 20*a* for receipt of prongs 18*a*, 18*b*, and 18*c* with openings 20*b* and 20*b* in opposite sides thereof for receipt of the outer shoulders 19*a* and 19*c* on prongs 18*a* and 18*c*, respectively, to selectively lock prongs 18*a* and 18*c* therein. Prongs 18*a*, 18*b*, and 18*c* are force fitted into hollow body 20*a* to fasten male portion 18 to female portion 20. Prongs 18*a* and 18*c* are depressed toward center prong 18*b* to release male portion 18 from female portion 20. Body 20*a* is integrally formed with a clasp 20*d*. The other end of strap 12 is received in clasp 20*d* and connected thereto to form loop 12*d* in strap 12 by connecting the end of strap 12 to strap 12 at 12*f* by sewing, riveting, or the like.

Two U-shaped flexible hooks generally indicated by the numerals 22 and 24 are integrally formed with clasps 18*d* and 20*d*, respectively. Hook 22 has a U-shaped body formed by two flexible parallel prongs 22*a* and 22*b*, and hook 24 has a U-shaped body formed by two flexible parallel prongs 24*a* and 24*b*. Prongs 22*a* and 22*b* have a semi-circular portion 22*e* adjacent to clasp 22*c* for snug receipt of the circular neck 25 of a beverage bottle 26 having a liquid 27 therein as shown in FIGS. 5–7 when the neck of beverage bottle 26 is force fitted therebetween, and prongs 24*a* and 24*b* have a semi-circular portion 24*e* adjacent to clasp 24*c* for snug receipt of the circular neck of a beverage bottle 26 as shown in FIGS. 5–7 when the neck of bottle 26 is force fitted therebetween.

To utilize the beverage bottle carrier of the invention, one beverage bottle 26 is connected to beverage bottle carrier 10 as shown in FIGS. 5 and 7 by force fitting the neck 25 of bottle 26 into hook 22 or 24, and male portion 18 may be buckled to female portion 20. The handle 14 of beverage bottle carrier 10 may then be grasped by the hand 32 of the user 34 to lift and carry beverage bottle 26 as shown in FIG. 7, or buckled beverage bottle carrier 10 may be placed over the shoulder of the user 34 as shown in FIG. 5. If desired, one beverage bottle 26 could be placed in hook 22 and another beverage bottle 26 could be placed in hook 24, and beverage bottle carrier 10 having two bottles attached thereto could be carried by the user 34 as shown in FIG. 5 or FIG. 7.

Figure 6:
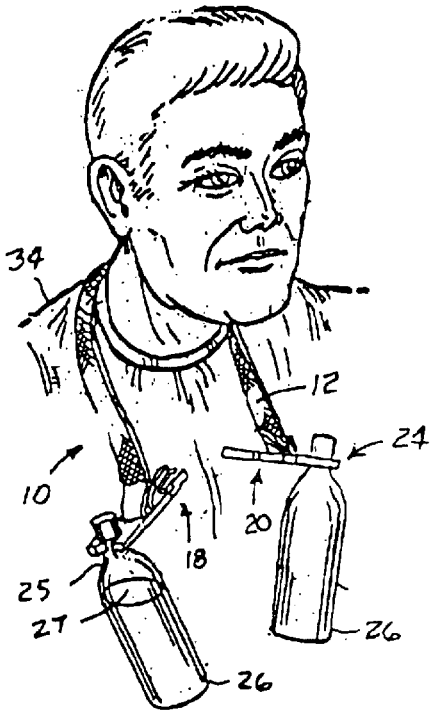
FIG. 6 is a partly cut-away perspective view of the beverage bottle carrier of the invention shown draped around the neck of a person carrying two beverage bottles.

Furthermore, as shown in FIG. 6, one beverage bottle 26 could be placed in hook 22 and another beverage bottle 26 could be placed in hook 24, and beverage bottle carrier 10 having two bottles attached thereto could be carried by the user 34 by draping strap 12 around the neck of the user 34.

Referring now to FIGS. 8–9 and 14–16, the second embodiment of the beverage bottle carrier of the invention is generally indicated by the numeral 40. Bottle carrier 40 includes a planar hook portion 40*a* and a planar belt receiving portion 40*b*. Hook portion 40*a* is preferably oriented generally perpendicular to belt receiving portion 40*b*.

Hook portion 40*a* has a U-shaped flexible hook generally indicated by the numeral 42. Hook 42 has a U-shaped body formed by two flexible parallel prongs 42*a* and 42*b*. Prongs 42*a* and 42*b* have a semi-circular portion 42*c* shown in FIG. 8 for snug receipt of the circular neck 25 of a beverage bottle 26 as shown in FIGS. 14–16 when the neck of beverage bottle 26 is force fitted therebetween.

Hook portion 40*a* has two parallel spaced apart side walls 44 and 46 extending from hook 42 to belt receiving portion 40*b*. At least one strap receiving bar 48 extends perpendicularly between side walls 44 and 46. If desired, a second bar 50 may extend between side walls 44 and 46 to strengthen hook portion 40*a*.

Figure 14:
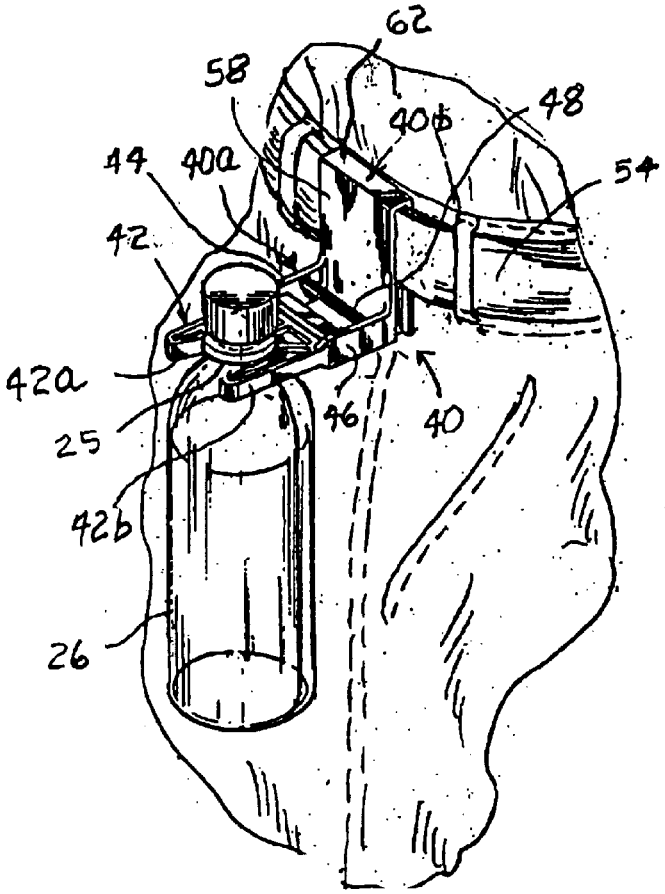
FIG. 14 is a partly cut-away perspective view of the beverage bottle carrier of the second embodiment of the invention shown attached to the belt of a person carrying a beverage bottle.
Figure 15:
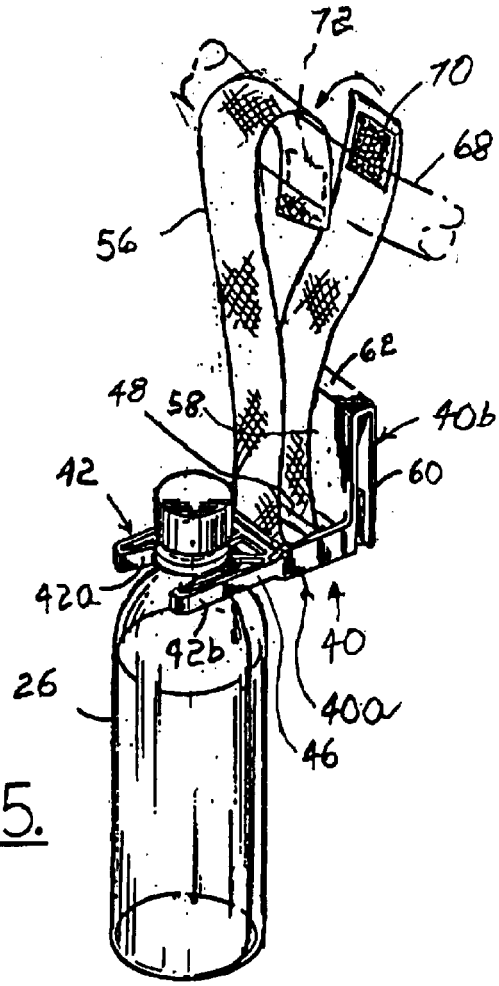
FIG. 15 is a partly cut-away perspective view of the beverage bottle carrier of the second embodiment of the invention shown attached to a rigid horizontal bar such as the handle bar of a bicycle by a strap having a fastener made from a hook and loop material.
Figure 16:
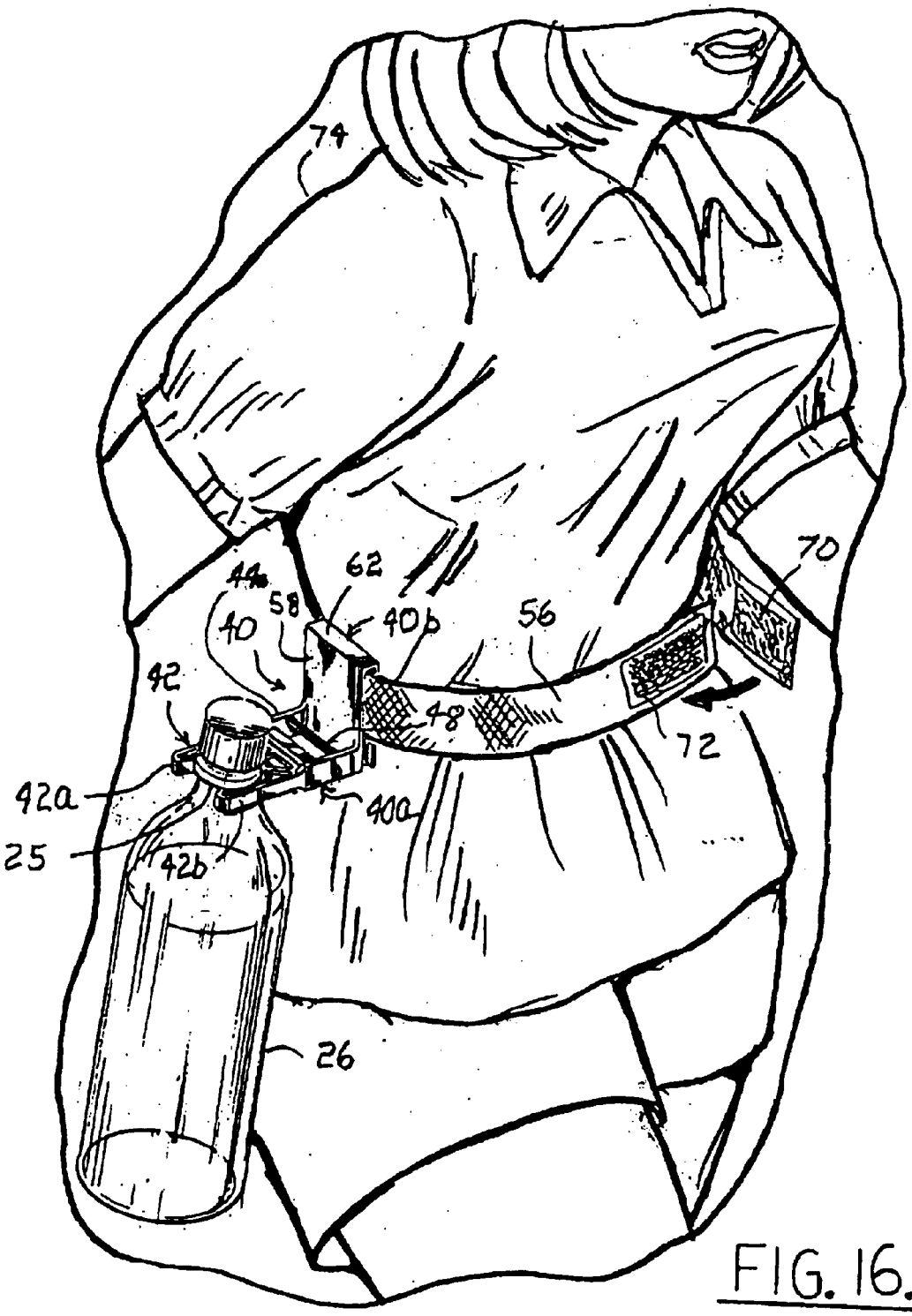
FIG. 16 is a partly cut-away perspective view of the beverage bottle carrier of the second embodiment of the invention shown attached to the waist of a person carrying a beverage bottle by a strap having a fastener made from a hook and loop material.

Belt receiving portion 40*b* has a hollow channel generally indicated by the numeral 52 therein for receipt of a belt 54 as shown in FIG. 14 or a horizontal strap 56 as shown in FIG. 16. As can best be seen in FIGS. 8 and 9, channel 52 is formed by spaced apart parallel front wall 58 and back wall 60 of belt receiving portion 40*b* and by spaced apart parallel top wall 62 and bottom wall 64.

As shown in FIG. 14, bottle carrier 40 is shown attached to belt 54 which is received in channel 52. Bottle 26 is shown received in hook 42 to suspend bottle 25 from the belt 54 of the user.

As shown in FIG. 15, a strap 56 is shown wrapped about strap receiving bar 48 and rigid member 68 to suspend bottle carrier 40 and bottle 26 therefrom. Strap 56 preferably has a fastening material 70 and 72 attached to opposite sides thereof for connecting the ends of strap 66 together around rigid member 68 as indicated by the arrow. Preferably fastening material 70 and 72 is a hook and loop material well known in the art. An example of such material is Velcro®. Rigid member 68 may be a handlebar of a bicycle or motor cycle or the like.

As shown in FIG. 16, strap 56 is extended through channel 52 of bottle carrier 40 and wrapped about the waist of the user 74. The ends of strap 56 are connected together by hook and loop material 70 and 72 as indicated by the arrow to fasten bottle carrier 40 and bottle 26 to the waist of user 74. Thus a user 74 may utilize the bottle carrier 40 of the invention to carry a water bottle or other bottle 26 on their waist while walking or engaging in other athletic activity.

Referring now to FIGS. 10–13, the third embodiment of the bottle carrier of the invention is generally indicated by the numeral 80. Bottle carrier 80 has an elongated handle generally indicated by the numeral 82 and a hook portion generally indicated by the numeral 84 located at each end of handle 82. Handle 82 is a rigid preferable cylindrical bar and preferably has a triangular portion 82*a* at each end thereof.

Hook portion 84 has a U-shaped flexible hook generally indicated by the numeral 86. Hook 86 has a U-shaped body formed by two flexible parallel prongs 86*a* and 86*b*. Prongs 86*a* and 86*b* have a semi-circular portion 86*c* shown in FIG. 10 for snug receipt of the circular neck 25 of a beverage bottle 26 as shown in FIGS. 12–13 when the neck of beverage bottle 26 is force fitted therebetween.

Hook portion 84 has two parallel spaced apart side walls 88 and 90 extending from hook 86 to triangular portion 82*a* of handle 82 At least one strap receiving bar 92 extends perpendicularly between side walls 88 and 90. If desired, a second bar 94 may extend between side walls 88 and 90 to strengthen hook portion 84.

Figure 12:
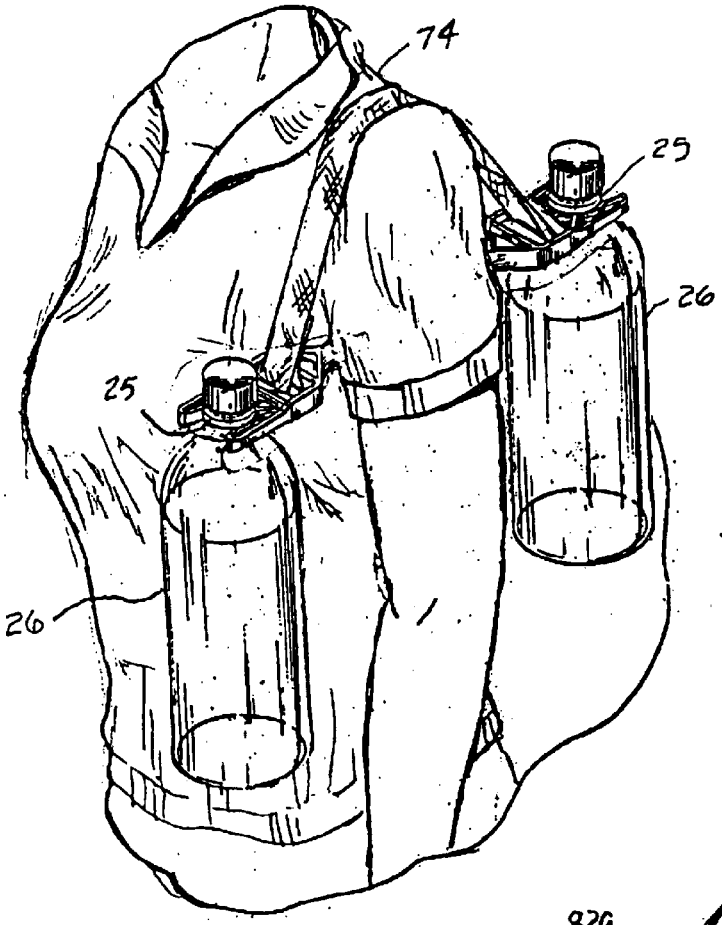
FIG. 12 is a partly cut-away perspective view of the beverage bottle carrier of the third embodiment of the invention shown between the upper arm and torso of a person carrying two beverage bottles supported by a strap over the shoulder of said person.

As shown in FIG. 12, a strap 96 is shown wrapped about strap receiving bar 92 and over the shoulder of the user 74 to suspend bottle carrier 80 and two bottles 26 from the user's shoulder and under the user's upper arm. Strap 96 preferably has a fastening material identical to fastening material 70 and 72 attached to the same sides of each end thereof for connecting the ends of strap 96 together around rigid member 92. If desired, strap 96 could be permanently attached at each end around rigid member 92 by forming a permanent loop at each end of strap 96 around rigid member 92.

Figure 13:
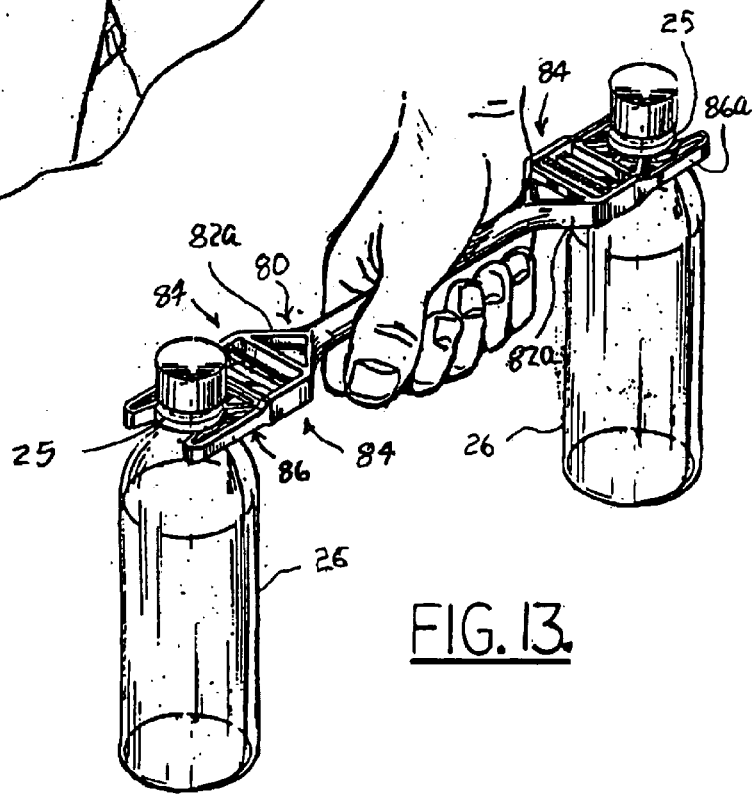
FIG. 13 is a partly cut-away perspective view of the beverage bottle carrier of the third embodiment of the invention shown supported by the hand of a person carrying two beverage bottles.

As can be seen in FIG. 13, bottle carrier 80 can support two bottles 26 and be lifted by one hand grasping handle 82.

Although the preferred embodiments of the invention have been described in detail above, it should be understood that the invention is in no sense limited thereby and its scope is to be determined by that of the following claims:

1. A beverage bottle carrier for carrying beverage bottles having a neck, said beverage bottle carrier comprising:

a. a belt receiving portion for attaching said bottle carrier to a belt around the waist of the user, said belt receiving portion lying in a plane, said belt receiving portion having a front wall and a back wall, said front wall and said back wall forming a hollow channel therein for receipt of a belt, a. a U-shaped hook portion for receiving and holding the neck of a beverage bottle, said U-shaped hook portion lying in a plane, said U-shaped hook portion being generally perpendicular to said belt receiving portion, said hook portion having a strap receiving bar for receiving a strap therearound for suspending said bottle carrier from said strap, said U-shaped hook portion having a hook mechanism adapted to be force-fitted around said neck of one of said beverage bottles to grasp and hold said neck of one of said beverage bottles therein, said hook mechanism having two generally parallel flexible prongs, said two prongs having a semi-circular portion between said two prongs adapted to receive said neck of said beverage bottle, said hook mechanism having two parallel spaced apart side walls extending therefrom and lying in the same plane as said U-shaped hook portion, one of said two parallel spaced apart side walls extending from one of said two prongs in alignment therewith to said back wall of said belt receiving portion and the other of said two parallel spaced apart side walls extending from the other of said two prongs in alignment therewith to said back wall of said belt receiving portion, said side walls having said strap receiving bar connected therebetween.

* * * * *